US005758379A

United States Patent [19]

Hovnanian

[11] Patent Number: 5,758,379

[45] Date of Patent: Jun. 2, 1998

[54] GOLF BALL WASHER AND CONDITIONER

[76] Inventor: Vahak Stephan Hovnanian, 520 Navesink River Rd., Middletown, N.J. 07748

[21] Appl. No.: 591,703

[22] Filed: Jan. 25, 1996

[51] Int. Cl.[6] ..... A63B 47/04

[52] U.S. Cl. ..... 15/97.1; 15/21.2

[58] Field of Search ..... 15/21.2, 97.1, 15/210.1; 219/201, 521, 385

[56] References Cited

U.S. PATENT DOCUMENTS

| | | | |
|---|---|---|---|
| 2,744,274 | 5/1956 | Procario et al. | 15/97.1 |
| 3,041,645 | 7/1962 | Smith | 15/21.2 |
| 3,077,626 | 2/1963 | Thomson | 15/97.1 |
| 3,831,001 | 8/1974 | Toomey et al. | 219/521 |
| 3,981,039 | 9/1976 | Rumph | 15/21.2 |
| 4,155,002 | 5/1979 | Cohen | 219/521 |
| 4,163,299 | 8/1979 | Duda | 15/21.2 |
| 4,420,681 | 12/1983 | Arnold | 219/521 |
| 4,967,062 | 10/1990 | Cohen | 219/521 |
| 5,057,670 | 10/1991 | Cohen | 219/521 |
| 5,339,486 | 8/1994 | Persic | 15/21.2 |
| 5,463,787 | 11/1995 | Burke et al. | 15/21.2 |
| 5,546,629 | 8/1996 | Shim | 15/21.2 |

FOREIGN PATENT DOCUMENTS

| | | | |
|---|---|---|---|
| 4117 | of 1883 | United Kingdom | 15/21.2 |

*Primary Examiner*—Terrence Till
*Attorney, Agent, or Firm*—Arthur M. Peslak

[57] ABSTRACT

A golf ball washer and conditioner is disclosed. The golf ball washer and conditioner is portable and may be carried by the golfer on a golf cart. The golf ball washer and conditioner is constructed from insulated material so that the golf balls can be kept warm during cold weather.

1 Claim, 4 Drawing Sheets

GOLF BALL WASHER AND CONDITIONER

BACKGROUND OF THE INVENTION

The present invention is directed to the field of golf ball washers and conditioners. In particular, the present invention is directed to a portable golf ball washer and conditioner that can be transported by the golfer on a manual or powered golf cart.

Many of the currently available golf ball washing devices are not portable but rather are permanently installed in various locations around the golf course. While these devices may suffice to wash the golf ball, they do not provide the conditioning aspect of the present invention.

One problematic aspect of the currently available golf ball washing devices, whether of the portable variety or the permanently installed variety, is that those devices do not allow the balls to be kept warm during cold weather. When the golf balls are cold, the distance on the golfers shot will be reduced compared to the same shot with a ball that has been kept warm. Thus, the present invention has as one its primary objects to solve the problem of keeping golf balls warm during cold weather. Thus, the present invention provides a portable golf ball washing device that also conditions the golf ball by keeping it warm.

SUMMARY OF THE INVENTION

The present invention is directed to a portable personal golf ball washing and conditioning device comprising a thermally insulated hollow chamber comprising an axis, a means for rotating a plurality of golf balls inside the hollow chamber about the axis of the hollow chamber and rotatably connected to the hollow chamber, a lid attached to the hollow chamber for insertion and removal of the plurality of golf balls into and out of the hollow chamber, a sponge like brush material attached to the interior of the hollow chamber, and a suction cup mounted to the exterior of the golf ball washing and conditioning device for attachment of the device to a golf cart.

DETAILED DESCRIPTION OF THE INVENTION

Figure 1:
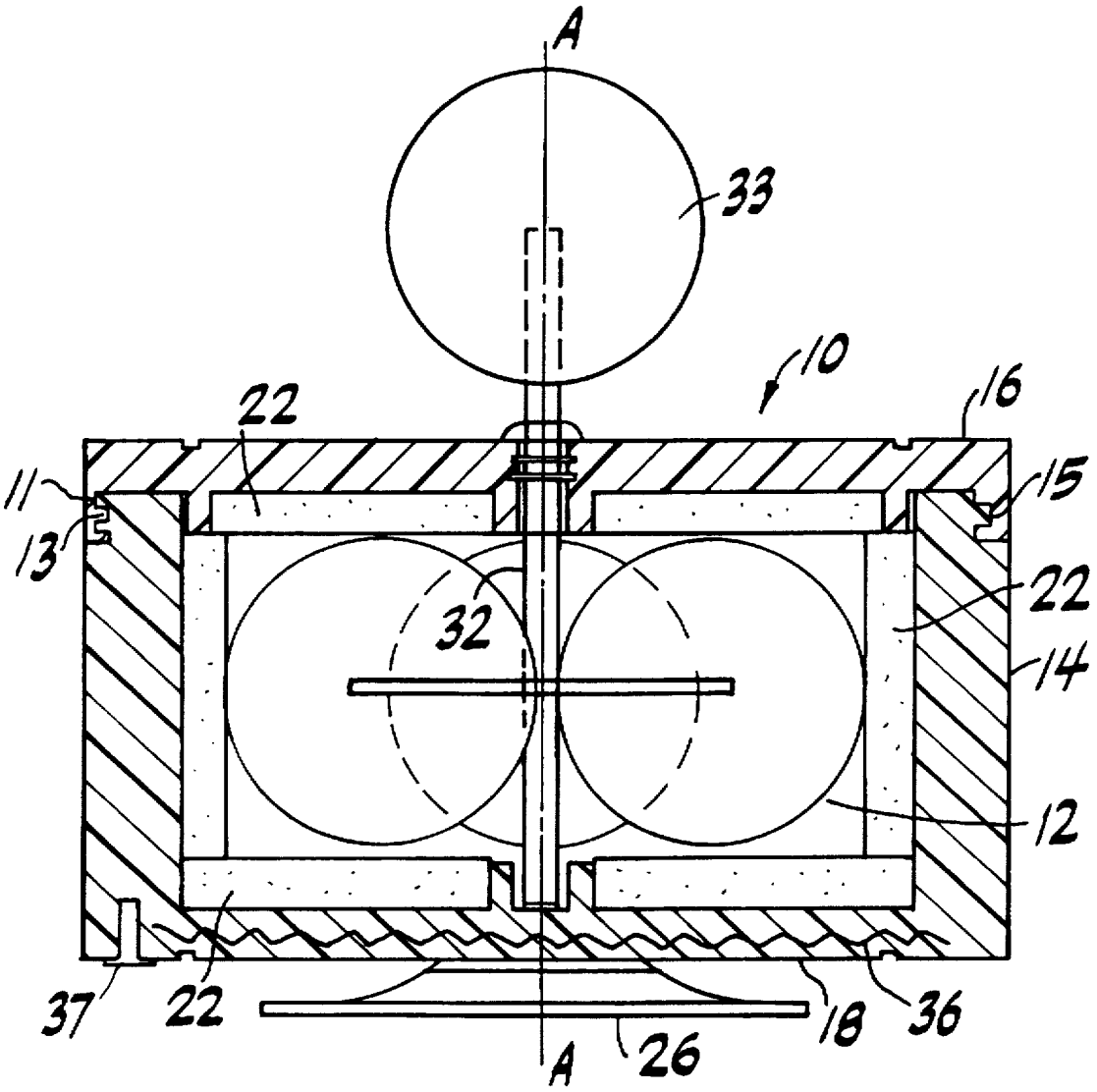
FIG. 1 is a front cross-sectional view of a device in accordance with the present invention.
Figure 2:
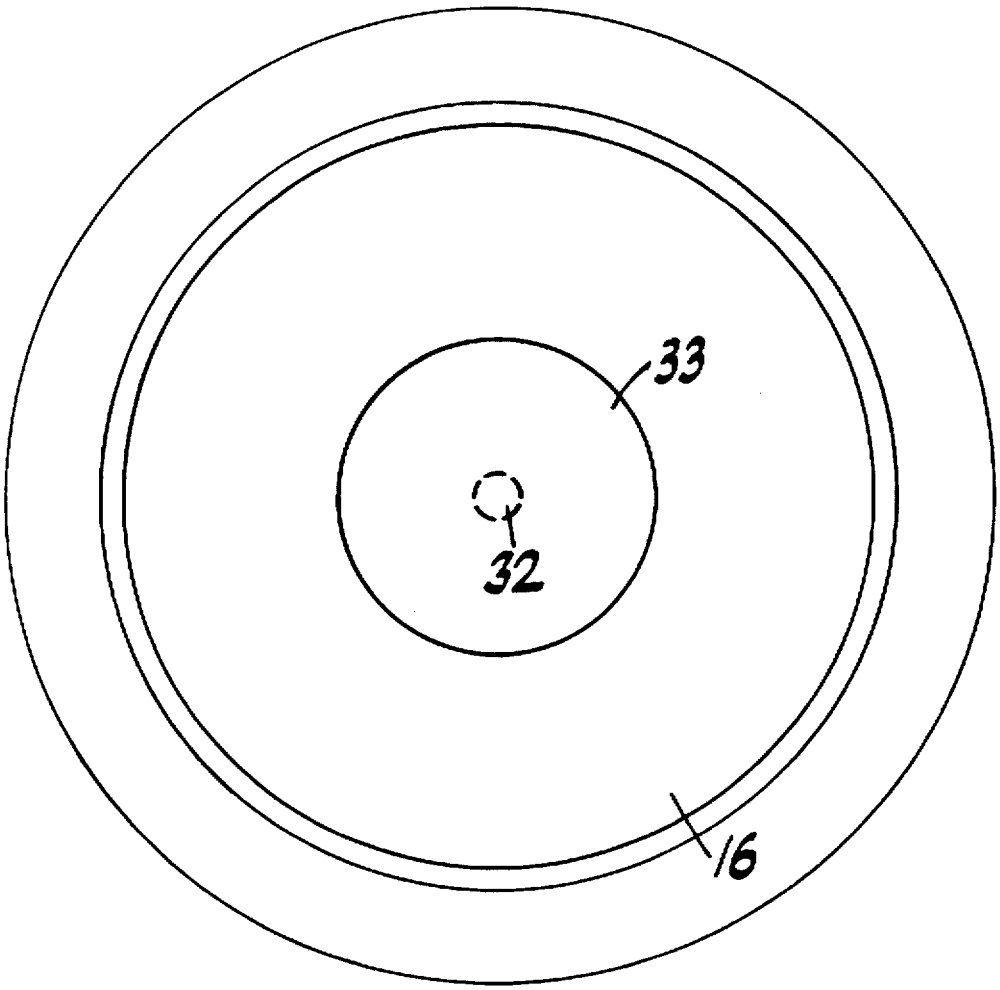
FIG. 2 is a top plan view of the device of FIG. 1.

A personal golf ball washing and conditioning device 10 according to the present invention is illustrated in the attached figures. The device 10 comprises a hollow container 12. The hollow container 12 comprises a cylindrical side wall 14, a top lid 16, and a bottom 18. The cylindrical side wall 14 is fabricated from a material such as plastic that serves as a thermal insulator. In addition, the cylindrical side wall 14 has a replaceable liner 22 placed on its inside wall. The liner 22 in this embodiment is fabricated from sponge material and serves as a brush for the golf balls.

The cylindrical side wall 14 is provided with threads 11 and a groove 13. The top lid 16 is provided with threads 15 that mate with threads 11 so that top lid 16 may be securely fastened onto cylindrical side wall 14. In addition both bottom 18 and top lid 16 have a sponge material 22 attached thereto that acts as a brush.

Figure 3:
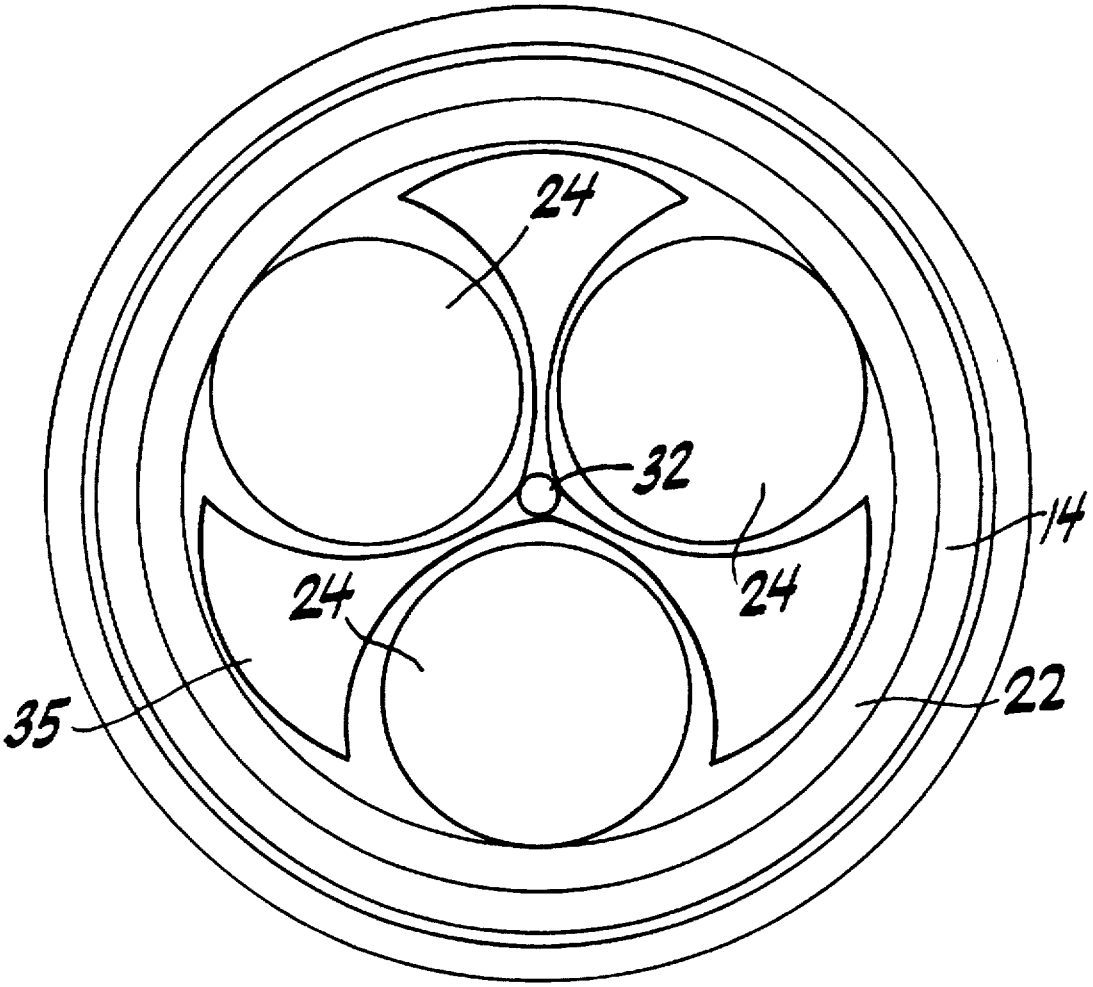
FIG. 3 is a top cross-sectional plan view of the device of FIG. 1.
Figure 4:
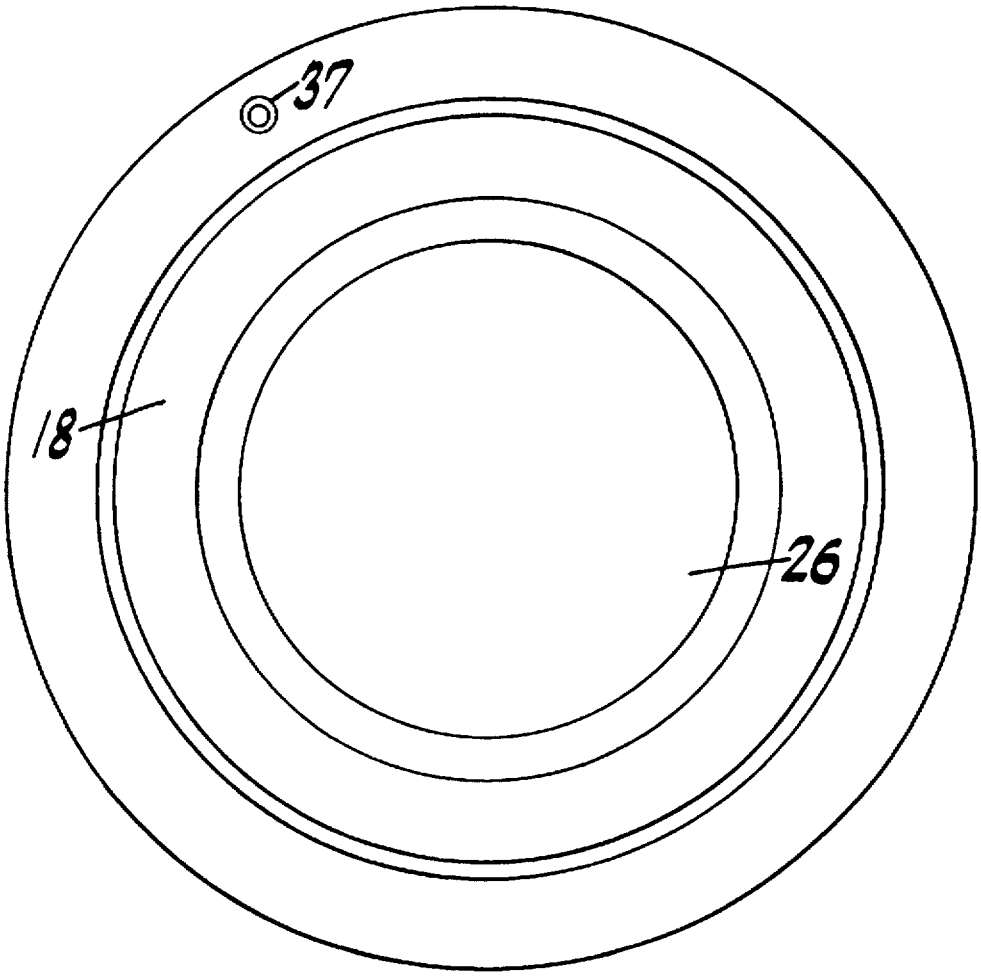
FIG. 4 is a bottom plan view of the device of FIG. 1.

As shown in FIG. 3, a rotatable shaft 32 of an approximate circular cross section is placed inside of the hollow container 12. Attached to rotatable shaft 32 are wing like projections 35. The rotatable shaft 32 fits into bottom 18 and is free to rotate about axis A—A as shown in FIG. 1. The rotatable shaft 32 is fixed to top lid 16 so when handle 33 is rotated the shaft 32 and wing-like projections 35 cause the golf balls 24 to rotate. As shown in FIG. 3, rotatable shaft 32 with wing-like projections 35 are sized so that three golf balls 24 may be carried in the device 10.

The device 10 also comprises a suction cup 26. Suction cup 26 is used to attach device 10 to a golf cart.

In use, three golf balls 24 will be placed in device 10 by opening top lid 16 and placing the balls 24 in container 12. Top lid 16 is opened by lifting the lid 16 off of groove 13. Hot water and possibly a cleaning solution will placed inside the container 12. After the golf balls 24 are placed in the container 12, the handle 33 will be rotated relative to the cylindrical side wall 14. Handle 33 will cause shaft 32 and the wing-like projections 35 to rotate thereby causing the balls 24 to rotate inside the cylindrical side wall 14. Through the action of the sponge liners 22, the balls will be cleaned by the fluid inside container 12. The balls may be removed one at a time as needed by the golfer by opening top lid 16 as described above. Since the cylindrical side wall 14 is comprised of a thermal insulating material, if the golf balls 24 are warm when placed inside the device 10, the balls should remain warm even during cold weather.

As shown in FIG. 1 bottom 18 also comprises a battery operated heating device 36 embedded in the wall of bottom 18. The heating device 36 is electrically connected to electrical jack 37. Electrical jack 37 is used to connect to a mating electrical jack on the golf cart(not shown) which electrically connects the heating device to the golf cart's battery. The heating device 36 is used to keep the golf balls 24 warm during extreme cold conditions.

Those of ordinary skill in the art will recognize that the embodiments just described merely illustrate the principles of the present invention. Many modifications may be made thereto without departing from the spirit and scope of the invention as set forth in the following claims.

What is claimed is:

1. A portable golf ball washing and conditioning device comprising:

a) a thermally insulated hollow chamber comprising an axis, said chamber having a wall;

b) a means for rotating a plurality of golf balls inside the hollow chamber about the axis of the hollow chamber and rotatably connected to the hollow chamber;

c) a lid attached to the hollow chamber for insertion and removal of the plurality of golf balls into and out of the hollow chamber;

d) a sponge like brush material attached to the interior of the hollow chamber;

e) a means mounted to the exterior of the golf ball washing and conditioning device for attachment of the device to a golf cart;

f) a heating means embedded in the wall of the hollow chamber for heating a plurality of golf balls comprising a battery operated heating device; and g) a means for electrically connecting the heating means to a battery.

* * * * *